US009920962B2

(12) United States Patent
Angle et al.

(10) Patent No.: US 9,920,962 B2
(45) Date of Patent: Mar. 20, 2018

(54) PACKAGED TERMINAL AIR CONDITIONER UNIT

(71) Applicant: General Electric Company, Schenectady, NY (US)

(72) Inventors: Jeffrey Alan Angle, Louisville, KY (US); Samuel Vincent DuPlessis, Louisville, KY (US); Richard Dustin Henderson, La Grange, KY (US); Robert Charles Beilfuss, Fisherville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 348 days.

(21) Appl. No.: 14/737,997

(22) Filed: Jun. 12, 2015

(65) Prior Publication Data

US 2016/0363366 A1 Dec. 15, 2016

(51) Int. Cl.
*F24F 1/02* (2011.01)
*F25B 13/00* (2006.01)

(52) U.S. Cl.
CPC ..... *F25B 13/00* (2013.01); *F24F 1/02* (2013.01)

(58) Field of Classification Search
CPC ..... F25B 13/00; F24F 1/02
See application file for complete search history.

(56) References Cited

U.S. PATENT DOCUMENTS 4,562,550 A * 12/1985 Beatty ..... H02J 13/0086 307/39
4,589,966 A * 5/1986 Ford ..... C25B 9/045 204/230.5
4,829,779 A * 5/1989 Munson ..... F24F 11/0009 236/51
5,555,456 A * 9/1996 Waite ..... G06F 11/0796 340/501
5,944,098 A 8/1999 Jackson
6,220,043 B1 * 4/2001 Chaney, Jr. ..... F24F 11/008 62/126
6,540,549 B2 4/2003 Rupert
6,876,103 B2 * 4/2005 Radusewicz ..... H02J 9/06 307/125
8,116,054 B2 * 2/2012 Vicente ..... H01H 71/7409 361/111

(Continued)

OTHER PUBLICATIONS

Hitman,"Making a transistor relay driver circuit," 2012, pp. 1-5.*

*Primary Examiner* — Thienvu Tran
*Assistant Examiner* — Pinping Sun
(74) *Attorney, Agent, or Firm* — Dority & Manning, P.A.

(57) ABSTRACT

A packaged terminal air conditioner unit is provided. The packaged terminal air conditioner unit can include a heater bank jumper configured to couple one or more heater banks to a controller associated with the packaged terminal air conditioner unit. The heater bank jumper can be selectively configurable to provide at least one shunt line to couple at least one contact point associated with the controller to at least one contact point associated with the one or more heater banks. In this manner, the heater bank jumper can be configured based at least in part on an amount of current provided to the packaged terminal air conditioner unit by an electric service.

19 Claims, 7 Drawing Sheets

(56) References Cited

U.S. PATENT DOCUMENTS

| | | | | |
|---|---|---|---|---|
| 2001/0007800 | A1* | 7/2001 | Skarie | H01R 13/64 439/188 |
| 2006/0164773 | A1* | 7/2006 | Stanford | H04L 49/351 361/93.1 |
| 2006/0196200 | A1* | 9/2006 | Harrod | F24F 11/006 62/160 |
| 2009/0160664 | A1* | 6/2009 | Martin-Otto | G06F 1/26 340/657 |
| 2009/0284374 | A1* | 11/2009 | Wisnudel | G11B 20/00086 340/568.2 |
| 2012/0280617 | A1* | 11/2012 | Josefowicz | H05B 33/0815 315/85 |
| 2013/0181736 | A1* | 7/2013 | Gostein | H02S 50/10 324/761.01 |
| 2014/0015487 | A1* | 1/2014 | Brown | B60L 3/0069 320/109 |
| 2014/0225455 | A1* | 8/2014 | Erwin | G05D 23/19 307/109 |
| 2014/0268473 | A1* | 9/2014 | Hassan-Ali | B60L 11/1818 361/179 |
| 2016/0061501 | A1* | 3/2016 | Billman | F24F 11/0009 62/115 |
| 2016/0131387 | A1* | 5/2016 | Sawada | H02H 3/253 62/158 |
| 2016/0252260 | A1* | 9/2016 | Jewell | F24F 1/022 62/259.1 |

* cited by examiner

PACKAGED TERMINAL AIR CONDITIONER UNIT

FIELD OF THE INVENTION

The present subject matter relates generally to heat pump systems, such as packaged terminal air conditioner units, and sealed systems for the same.

BACKGROUND OF THE INVENTION

Certain packaged terminal air conditioner units include a sealed system for chilling and/or heating air. The sealed systems include various components for treating a refrigerant in order to cool or heat air. The sealed system components are generally positioned within a casing that can be mounted within a wall or window of an associated building. The sealed system can generally include a controller configured to control one or more of the sealed system components. Such sealed system components may be coupled to a circuit board in the packaged terminal air conditioner unit using complicated and/or costly wire configurations. Such wire configurations can be unwieldy and inefficient. In addition, such wire configurations may be difficult to secure within the confines of the casing of the packaged terminal air conditioner unit. Thus, a need exists for a packaged terminal air conditioner unit having a simplified wire configuration design.

BRIEF DESCRIPTION OF THE INVENTION

Aspects and advantages of the invention will be set forth in part in the following description, or may be apparent from the description, or may be learned through practice of the invention.

One example aspect of the present disclosure is directed to a packaged terminal air conditioner unit. The packaged terminal air conditioner unit comprises a casing, a compressor positioned within the casing, an interior coil positioned within the casing, an exterior coil positioned within the casing opposite the interior coil, and one or more associated power relay coils. The packaged terminal air conditioner unit further comprises a jumper coupled to the one or more power relay coils. The jumper has one or more shunt lines configured to conduct one or more command signals from a controller to at least one of the one or more power relay coils, the one or more shunt lines being selectively configurable based are least in part on a current rating of a wall receptacle associated with the packaged terminal air conditioner unit.

Another example aspect of the present disclosure is directed to a packaged terminal air conditioner unit. The packaged terminal air conditioner unit comprises a casing extending between an exterior side portion and an interior side portion. The packaged terminal air conditioner unit further comprises a compressor positioned within the casing operable to compress a refrigerant, a controller configured to control the operation of one or more associated power relay coils, and one or more heater banks coupled to the one or more associated power relay coils. The packaged terminal air conditioner unit further comprises a heater bank jumper disposed between one or more contact point pairs. The heater bank jumper has one or more conductive shunt lines configured to provide a path for current to flow from the controller to at least a subset of the power relay coils. The conductive shunt line configuration is selectively configurable based at least in part on a current rating of a receptacle associated with the packaged terminal air conditioner unit.

Yet another aspect of the present disclosure is directed to a method of operating a packaged terminal air conditioner unit comprising a casing extending between an exterior side portion and an interior side portion, a compressor positioned within the casing operable to compress a refrigerant, and one or more heater banks within the casing each having at least one resistive heating element. The method comprises accessing the packaged terminal air conditioner unit. The method further comprises configuring a shunt line arrangement of a jumper based at least in part on a current rating of a wall receptacle associated with the packaged terminal air conditioner unit. The jumper is configured to conduct one or more command signals to at least one of the one or more heater banks.

Additional aspects and advantages of the invention will be set forth in part in the following description, or may be apparent from the description, or may be learned through practice of the invention.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
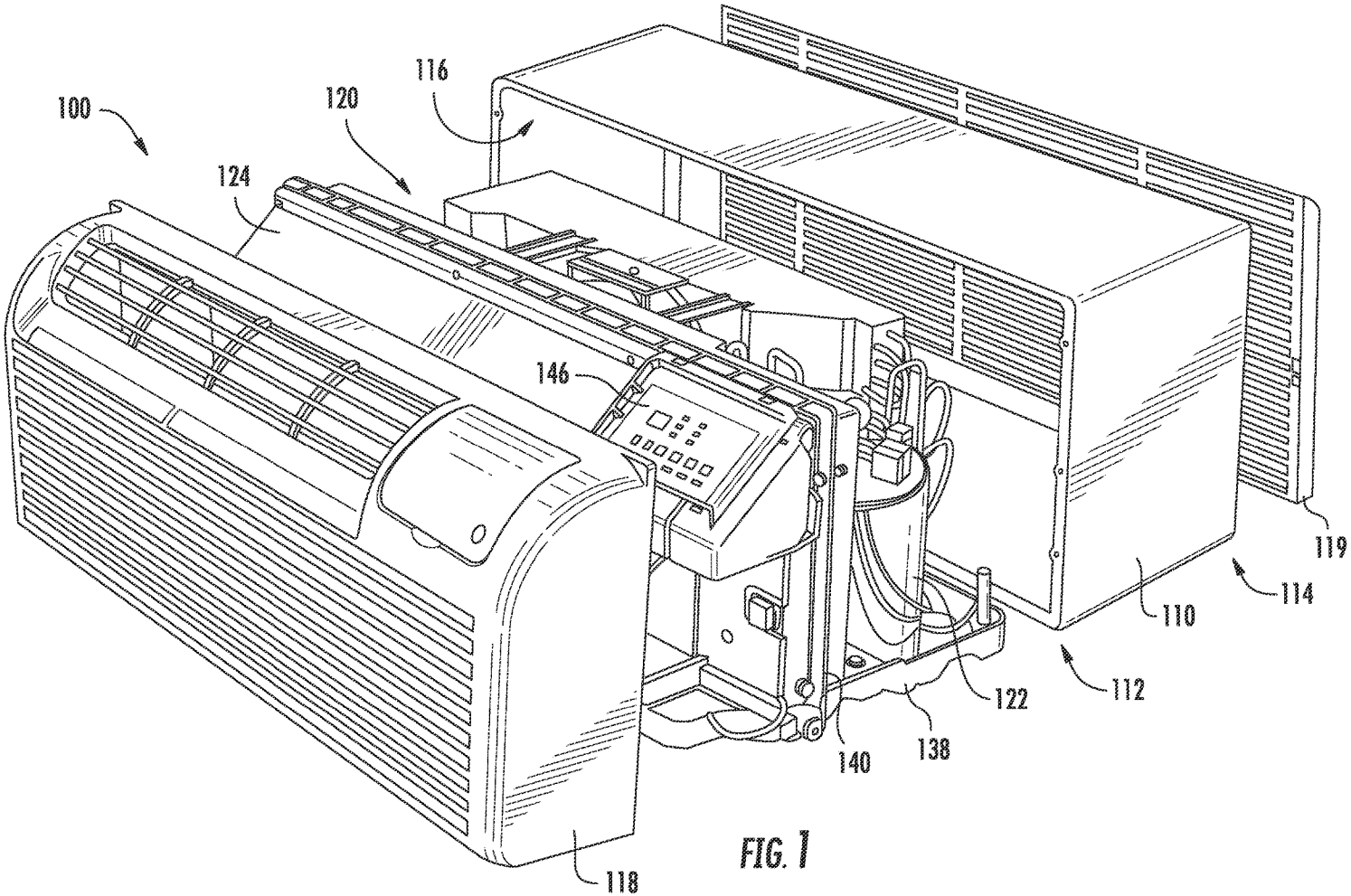
FIG. 1 depicts an exploded perspective view of an example packaged terminal air conditioner unit according to example embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Example aspects of the present disclosure are directed to a packaged terminal air conditioner unit. The packaged terminal air conditioner unit can include a jumper harness associated with the packaged terminal air conditioner unit. Such jumper harness can include one or more connectors coupled to one or more wires. In particular, the jumper harness can have a heater bank jumper that couples one or more power relay coils in the packaged terminal air conditioner unit to a controller, such as a microcontroller. The controller can provide command signals to the relay coils through the heater bank jumper. In example embodiments, such command signals can be configured to control one or more heater banks in the packaged terminal air conditioner unit. In particular, the heater bank jumper can be selectively configurable to facilitate the energizing of various heater bank arrangements based at least in part on a current rating of a wall receptacle associated with the packaged terminal air conditioner unit.

FIG. 1 provides an exploded perspective view of an example packaged terminal air conditioner unit 100 according to example embodiments of the present disclosure. Packaged terminal air conditioner unit 100 is operable to generate chilled and/or heated air in order to regulate the temperature of an associated room or building. As will be understood by those skilled in the art, packaged terminal air conditioner unit 100 may be utilized in installations where split heat pump systems are inconvenient or impractical. As discussed in greater detail below, a sealed system 120 of packaged terminal air conditioner unit 100 is disposed within a casing 110. Thus, packaged terminal air conditioner unit 100 may be a self-contained or autonomous system for heating and/or cooling air.

As may be seen in FIG. 1, casing 110 extends between an interior side portion 112 and an exterior side portion 114. Interior side portion 112 of casing 110 and exterior side portion 114 of casing 110 are spaced apart from each other. Thus, interior side portion 112 of casing 110 may be positioned at or contiguous with an interior atmosphere, and exterior side portion 114 of casing 110 may be positioned at or contiguous with an exterior atmosphere. Sealed system 120 includes components for transferring heat between the exterior atmosphere and the interior atmosphere. For example, sealed system 120 includes a compressor 122, an interior heat exchanger or coil 124 and an exterior heat exchanger or coil 126.

Casing 110 defines a mechanical compartment 116. Sealed system 120 is disposed or positioned within mechanical compartment 116 of casing 110. A front panel 118 and a rear grill or screen 119 are mounted to casing 110 and hinder or limit access to mechanical compartment 116 of casing 110. Front panel 118 is mounted to casing 110 at interior side portion 112 of casing 110, and rear screen 119 is mounted to casing 110 at exterior side portion 114 of casing 110. Front panel 118 and rear screen 119 each define a plurality of holes that permit air to flow through front panel 118 and rear screen 119, with the holes sized for preventing foreign objects from passing through front panel 118 and rear screen 119 into mechanical compartment 116 of casing 110.

Packaged terminal air conditioner unit 100 also includes a drain pan or bottom tray 138 and an inner wall 140 positioned within mechanical compartment 116 of casing 110. Sealed system 120 is positioned on bottom tray 138. Thus, liquid runoff from sealed system 120 may flow into and collect within bottom tray 138. Inner wall 140 may be mounted to bottom tray 138 and extend upwardly from bottom tray 138 to a top wall of casing 110. Inner wall 140 limits or prevents air flow between interior side portion 112 of casing 110 and exterior side portion 114 of casing 110 within mechanical compartment 116 of casing 110. Thus, inner wall 140 may divide mechanical compartment 116 of casing 110.

Packaged terminal air conditioner unit 100 further includes a controller 146 with user inputs, such as buttons, switches and/or dials. Controller 146 regulates operation of packaged terminal air conditioner unit 100. Thus, controller 146 is in operative communication with various components of packaged terminal air conditioner unit 100, such as components of sealed system 120, one or more heater banks, and/or a temperature sensor, such as a thermistor or thermocouple, for measuring the temperature of the interior atmosphere. In particular, controller 146 may selectively activate sealed system 120 and/or the one or more heater banks in order to chill or heat air within sealed system 120, e.g., in response to temperature measurements from the temperature sensor.

Controller 146 includes memory and one or more processing devices such as microprocessors, CPUs or the like, such as general or special purpose microprocessors operable to execute programming instructions or micro-control code associated with operation of packaged terminal air conditioner unit 100. The memory can represent random access memory such as DRAM, or read only memory such as ROM or FLASH. The processor executes programming instructions stored in the memory. The memory can be a separate component from the processor or can be included onboard within the processor. Alternatively, controller 146 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Figure 2:
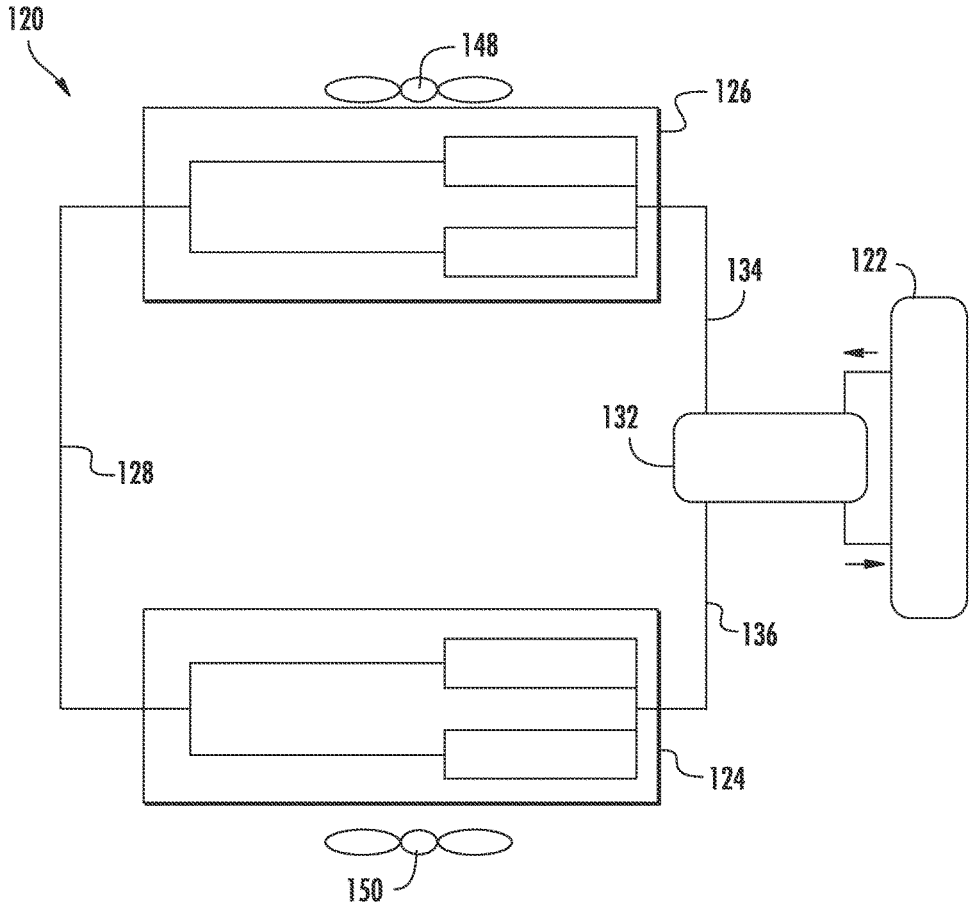
FIG. 2 depicts a schematic view of an example sealed system of a packaged terminal air conditioner unit according to example embodiments of the present disclosure.

FIG. 2 provides a schematic view of certain components of packaged terminal air conditioner unit 100, including sealed system 120. Sealed system 120 generally operates in a heat pump cycle. Sealed system 120 includes a compressor 122, an interior heat exchanger or coil 124 and an exterior heat exchanger or coil 126. As is generally understood, various conduits may be utilized to flow refrigerant between the various components of sealed system 120. Thus, e.g., interior coil 124 and exterior coil 126 may be between and in fluid communication with each other and compressor 122.

As may be seen in FIG. 2, sealed system 120 also includes a reversing valve 132. Reversing valve 132 selectively directs compressed refrigerant from compressor 122 to either interior coil 124 or exterior coil 126. For example, in a cooling mode, reversing valve 132 is arranged or configured to direct compressed refrigerant from compressor 122 to exterior coil 126. Conversely, in a heating mode, reversing valve 132 is arranged or configured to direct compressed refrigerant from compressor 122 to interior coil 124. Thus, reversing valve 132 permits sealed system 120 to adjust between the heating mode and the cooling mode, as will be understood by those skilled in the art.

During operation of sealed system 120 in the cooling mode, refrigerant flows from interior coil 124 through compressor 122. For example, refrigerant may exit interior coil 124 as a fluid in the form of a superheated vapor. Upon exiting interior coil 124, the refrigerant may enter compressor 122. Compressor 122 is operable to compress the refrigerant. Accordingly, the pressure and temperature of the refrigerant may be increased in compressor 122 such that the refrigerant becomes a more superheated vapor.

Exterior coil 126 is disposed downstream of compressor 122 in the cooling mode and acts as a condenser. Thus, exterior coil 126 is operable to reject heat into the exterior atmosphere at exterior side portion 114 of casing 110 when sealed system 120 is operating in the cooling mode. For example, the superheated vapor from compressor 122 may enter exterior coil 126 via a first distribution conduit 134 that extends between and fluidly connects reversing valve 132 and exterior coil 126. Within exterior coil 126, the refrigerant from compressor 122 transfers energy to the exterior atmosphere and condenses into a saturated liquid and/or liquid vapor mixture. An exterior air handler or fan 150 is positioned adjacent exterior coil 126 may facilitate or urge a flow of air from the exterior atmosphere across exterior coil 126 in order to facilitate heat transfer.

Sealed system 120 also includes a capillary tube 128 disposed between interior coil 124 and exterior coil 126, e.g., such that capillary tube 128 extends between and fluidly couples interior coil 124 and exterior coil 126. Refrigerant, which may be in the form of high liquid quality/saturated liquid vapor mixture, may exit exterior coil 126 and travel through capillary tube 128 before flowing through interior coil 124. Capillary tube 128 may generally expand the refrigerant, lowering the pressure and temperature thereof. The refrigerant may then be flowed through interior coil 124.

Interior coil 124 is disposed downstream of capillary tube 128 in the cooling mode and acts as an evaporator. Thus, interior coil 124 is operable to heat refrigerant within interior coil 124 with energy from the interior atmosphere at interior side portion 112 of casing 110 when sealed system 120 is operating in the cooling mode. For example, the liquid or liquid vapor mixture refrigerant from capillary tube 128 may enter interior coil 124 via a second distribution conduit 136 that extends between and fluidly connects interior coil 124 and reversing valve 132. Within interior coil 124, the refrigerant from capillary tube 128 receives energy from the interior atmosphere and vaporizes into superheated vapor and/or high quality vapor mixture. An interior air handler or fan 148 is positioned adjacent interior coil 124 may facilitate or urge a flow of air from the interior atmosphere across interior coil 124 in order to facilitate heat transfer.

During operation of sealed system 120 in the heating mode, reversing valve 132 reverses the direction of refrigerant flow through sealed system 120. Thus, in the heating mode, interior coil 124 is disposed downstream of compressor 122 and acts as a condenser, e.g., such that interior coil 124 is operable to reject heat into the interior atmosphere at interior side portion 112 of casing 110. In addition, exterior coil 126 is disposed downstream of capillary tube 128 in the heating mode and acts as an evaporator, e.g., such that exterior coil 126 is operable to heat refrigerant within exterior coil 126 with energy from the exterior atmosphere at exterior side portion 114 of casing 110.

It should be understood that sealed system 120 described above is provided by way of example only. In alternative example embodiments, sealed system 120 may include any suitable components for heating and/or cooling air with a refrigerant. Similarly, sealed system 120 may have any suitable arrangement or configuration of components for heating and/or cooling air with a refrigerant in alternative example embodiments.

Figure 3:
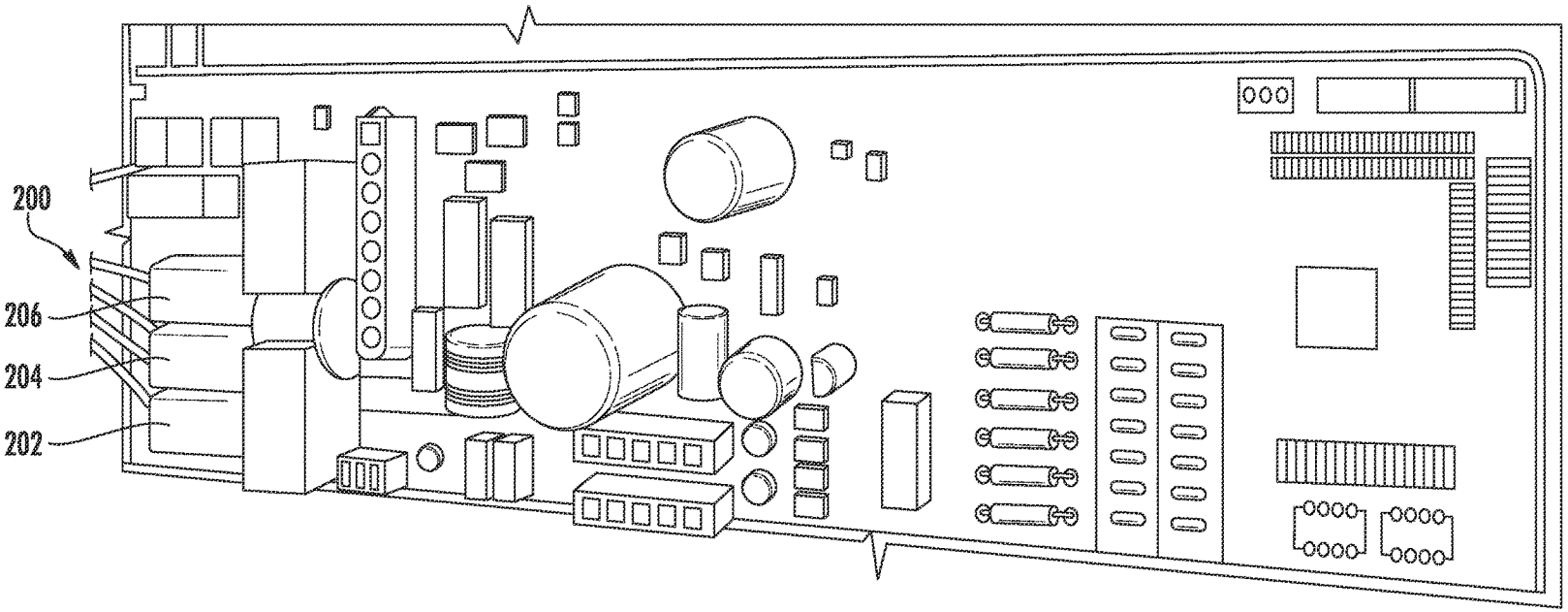
FIG. 3 depicts a perspective view of a circuit board of a packaged terminal air conditioner unit according to example embodiments of the present disclosure.

FIG. 3 depicts an example circuit board 200 of packaged terminal air conditioner unit 100 according to example embodiments of the present disclosure. Circuit board 200 may be configured to facilitate the operation of packaged terminal air conditioner unit 100 in a heating mode or a cooling mode, for instance, in accordance with the desires of a user and/or based on a measured temperature. As shown, circuit board 230 includes a printed circuit board 232 and a plurality of electrical components. For instance, circuit board 200 can include one or more power relay coils 202-206. Power relay coils 202-206 can be configured to control the operation of one or more heater banks associated with sealed system 120. In particular, each power relay coil 202-206 can have one or more associated heater banks. At least one of the heater banks can be energized in a heating mode to provide heat in addition to, or instead of, sealed system 120. The one or more heater banks can include at least one resistive heating element, and can have various suitable power ratings. For instance, packaged terminal air conditioner unit 100 may include a heater bank rated at 1000 watts, a heater bank rated at 1400 watts, and/or a heater bank rated at 2400 watts. It will be appreciated that packaged terminal air conditioner unit 100 may include various other suitable heater banks having various other suitable power ratings.

Figure 4:
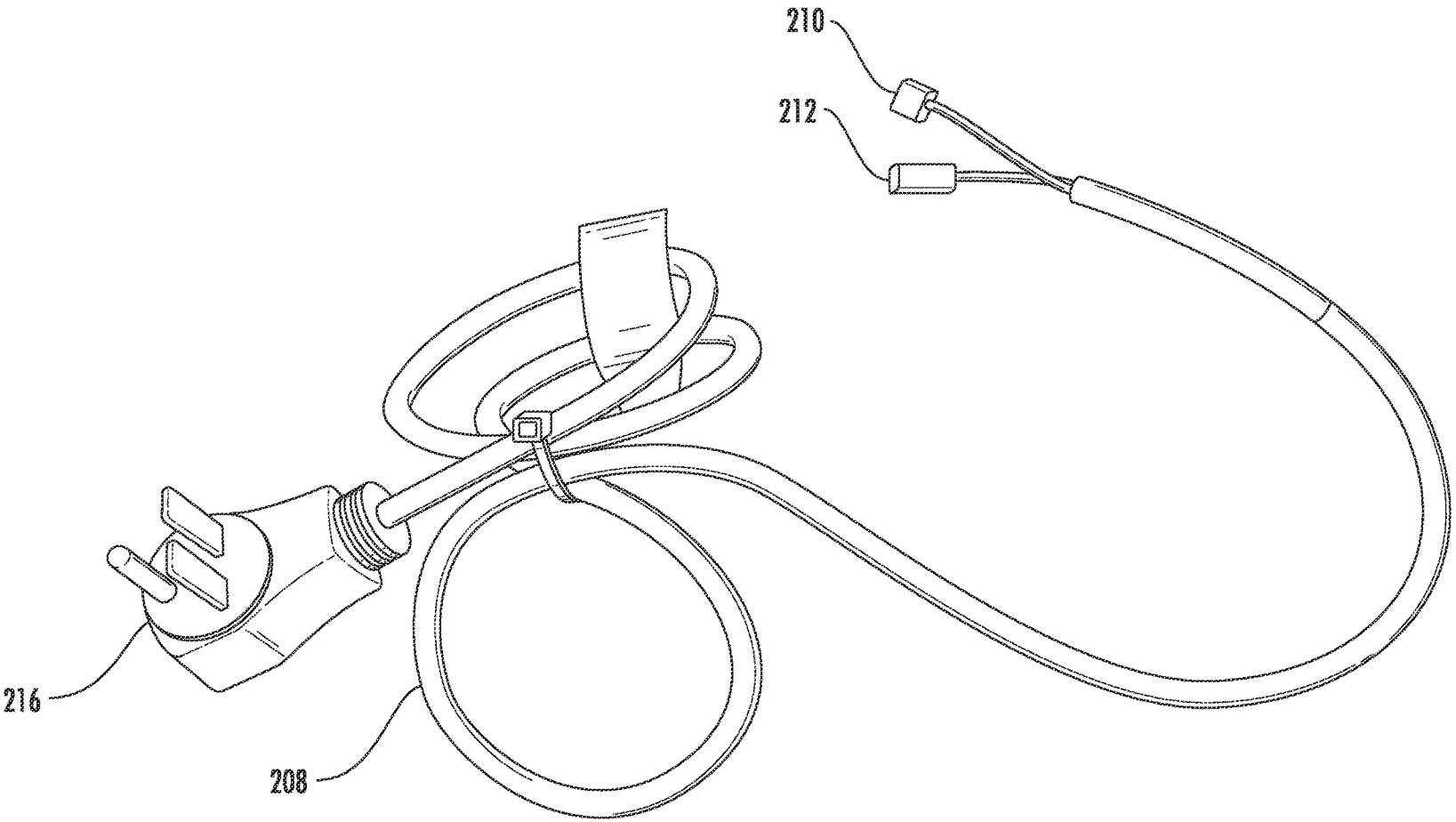
FIG. 4 depicts an example jumper harness according to example embodiments of the present disclosure.

Relay coils 202-206 can be coupled to a controller (e.g. controller 146) via a jumper harness. For instance, FIG. 4 depicts a jumper harness 208 according to example embodiments of the present disclosure. As shown, jumper harness 208 includes a heater bank jumper 210 and a power connector 212 connected to a power cord 214. Power connector 212 can be used to power one or more electrical components of packaged terminal air conditioner unit 100. Power cord 214 can include a plug 216. Plug 216 can be configured to fit in a wall receptacle having various suitable current ratings (e.g. 15 amps 20 amps, or 30 amps). In particular, the receptacle can receive power from an associated power supply and can provide an electric current signal to the packaged terminal air conditioner unit via jumper harness 208. The power supply can be associated with an electric service, such as a utility provider.

Heater bank jumper 210 can be used to couple controller 146 to relay coils 202-206. In this manner, heater bank jumper 210 may be configured to fit in a receptacle located on packaged terminal air conditioner unit 100. The receptacle can have one or more contact points of controller 146 and one or more contact points of relay coils 202-206. When plugged into the receptacle, heater bank jumper 210 can act as a shunt between at least one of the one or more contact points of controller 146, and at least one of the one or more contact points of relay coils 202-206 (e.g. between at least one contact point pair). Controller 146 can then be configured to provide command signals to control the operation (e.g. the opening and closing) of relay coils 202-206. In example embodiments, controller 146 can provide command signals to one or more relay drivers that can be configured to control the operation of relay coils 202-206. As indicated above, relay coils 202-206 can be further coupled to the one or more associated heater banks. The heater banks can be configured to be energized upon the closing of their associated relay coils 202-206.

In example embodiments, depending on the current rating of the wall receptacle, one or more of the heater banks in packaged terminal air conditioner unit 100 may not be used. For instance, sealed system 120 can have a 1000 watt heater bank, a 1400 watt heater bank, and a 2400 watt heater bank. During a heating mode, packaged terminal air conditioner unit 100 can be configured to energize at least a subset of the heater banks based at least in part on the current rating of the wall receptacle. For instance, if a wall receptacle having a 15 amp current rating is provided, the 1000 watt heater bank and the 1400 watt heater bank may be energized, but not the 2400 watt heater bank. As another example, if a wall receptacle having a 20 amp current rating is provided, the 1000 watt heater bank and the 2400 watt heater bank may be energized, but not the 1400 watt heater bank. If a receptacle rated at 30 amps is provided, all three heater banks may be energized. It will be appreciated by those skilled in the art that various other wall receptacles, heater banks and/or heater bank configurations may be used in association with a supplied current. For instance, packaged terminal air conditioner unit 100 may include any suitable number of heater banks having various suitable power ratings, and may energize such heater banks in various suitable manners.

Figure 5:
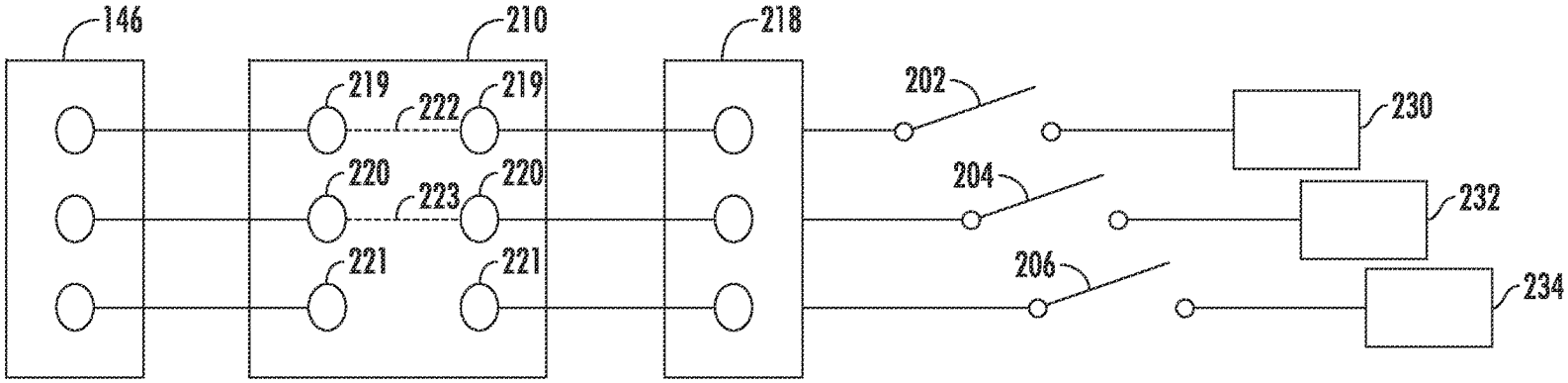
FIG. 5 depicts an example heater bank jumper according to example embodiments of the present disclosure.

Heater bank jumper 210 can be selectively configured depending on the current rating of the wall receptacle. In particular, heater bank jumper 210 can have various shunt line configurations that connect controller 146 and relay coils 202-206. For instance, FIG. 5 depicts an example heater bank jumper 210 according to example embodiments of the present disclosure. FIG. 5 further depicts a controller 146, and a relevant portion of a relay driver 218. Heater bank jumper can be disposed between one or more contact point pairs 219, 220, and 221. Contact point pairs 219-221 can each comprise a contact point of controller 146 and a contact point of relay driver 218. Heater bank jumper 210 can be populated with one or more conductive shunt lines that connect one or more contact point pairs, and provide a path for current to flow from controller 146 to relay driver 218 via the respective contact point pairs. Relay driver 218 can be configured to control the operation of relay coils 202-206.

For instance, in continuing the above example, if a wall receptacle is rated at 15 amps, heater bank jumper 210 can be populated with a shunt line 222 that connects contact point pair 219, such that a current can flow from controller 146 to the relay coil that corresponds to the 1000 watt heater bank (e.g. heater bank 230). Heater bank jumper 210 can be further populated with a shunt line 223 connecting contact point pair 220, such that a current can flow from controller 146 to the relay coil corresponding to the 1400 watt heater bank (e.g. heater bank 232). In such scenario, heater bank jumper 210 may not be populated with a shunt line connecting contact point pair 221, such that current may not flow to the relay coil corresponding to the 2400 watt heater bank (e.g. heater bank 234).

Figure 6:
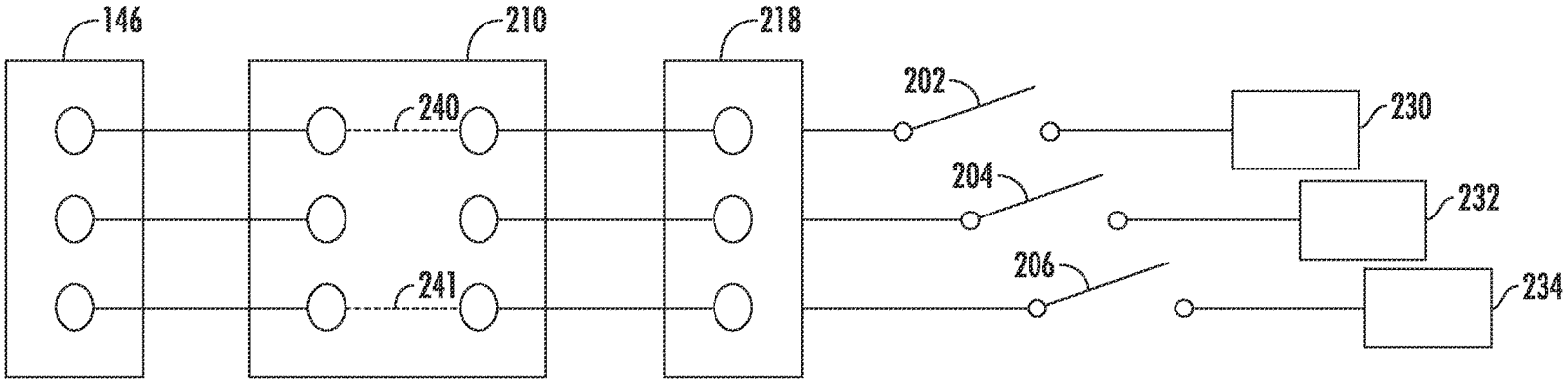
FIG. 6 depicts an example heater bank jumper according to example embodiments of the present disclosure.

FIG. 6 depicts heater bank jumper 210 wherein a wall receptacle rated for 20 amps is provided. As shown, in this scenario, heater bank jumper 210 may be populated with shunt lines 240 and 241 that connect contact point pairs 219 and 221 respectively, but may not be populated with a shunt line connecting contact point pair 220.

Figure 7:
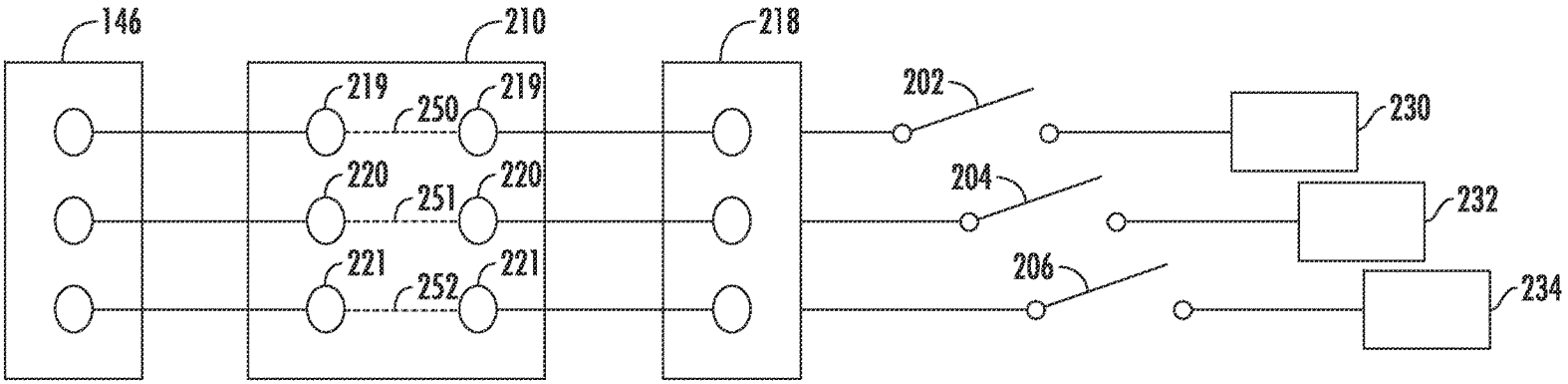
FIG. 7 depicts an example heater bank jumper according to example embodiments of the present disclosure.

FIG. 7 depicts heater bank jumper 210 wherein a wall receptacle rated for 30 amps is provided. As shown, in this scenario, heater bank jumper 210 may be populated with shunt lines 250-252 that connect all three contact point pairs 219-221. It will be appreciated that although FIGS. 5-7 depict a six-pin (e.g. six contact point) heater bank jumper, various other suitable heater bank jumpers may be used, having various other suitable pin configurations.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A packaged terminal air conditioner unit, comprising:
a casing;
a compressor positioned within the casing, the compressor operable to increase a pressure of a refrigerant;
an interior coil positioned within the casing;
an exterior coil positioned within the casing opposite the interior coil;
one or more associated power relay coils;
a controller; and
a heater bank jumper coupled between the controller and one or more power relay coils, the heater bank jumper having one or more shunt lines configured to conduct one or more command signals from the controller to at least one of the one or more power relay coils, the one or more shunt lines being selectively configurable based at least in part on a current rating of a wall receptacle associated with the packaged terminal air conditioner unit.

2. The packaged terminal air conditioner unit of claim 1, wherein the one or more power relay coils are configured to control the operation of one or more heater banks associated with the packaged terminal air conditioner unit.

3. The packaged terminal air conditioner unit of claim 2, wherein only a subset of the heater banks is energized during a heating mode of the packaged terminal air conditioner unit.

4. The packaged terminal air conditioner unit of claim 3, wherein the subset of heater banks is determined based at least in part on the current rating of the wall receptacle.

5. The packaged terminal air conditioner unit of claim 4, wherein the shunt lines of the jumper are configured to conduct command signals only to the power relay coils that correspond to the subset of heater banks.

6. The packaged terminal air conditioner unit of claim 2, wherein each heater bank is energized during a heating mode of the packaged terminal air conditioning unit.

7. The packaged terminal air conditioner unit of claim 1, wherein the heater bank jumper is further coupled to a power cord.

8. The packaged terminal air conditioner unit of claim 7, wherein the power cord is further coupled to a plug configured to fit in the wall receptacle.

9. The packaged terminal air conditioner unit of claim 8, wherein the wall receptacle is associated with a power source.

10. The packaged terminal air conditioner unit of claim 8, wherein the wall receptacle has a current rating of 15 amps, 20 amps, or 30 amps.

11. The packaged terminal air conditioner unit of claim 8, where the power cord is further connected to a power connector configured to connect to one or more electrical components of the packaged terminal air conditioner unit.

12. The packaged terminal air conditioner unit of claim 1, wherein the heater bank jumper is configured to fit in a receptacle located on the packaged terminal air conditioner unit, the receptacle having one or more contact points of the controller and one or more contact points of the power relay coils.

13. The packaged terminal air conditioner unit of claim 1, wherein the one or more power relay coils are coupled to the heater bank jumper via one or more relay drivers.

14. A packaged terminal air conditioner unit comprising:
a casing extending between an exterior side portion and an interior side portion;
a compressor positioned within the casing, the compressor operable to compress a refrigerant;

a controller configured to control the operation of one or more associated power relay coils;

one or more heater banks coupled to the one or more power relay coils; and a heater bank jumper coupled between the controller and the one or more associated power relay coils, the heater bank jumper having one or more conductive shunt lines configured to provide a path for current to flow from the controller to at least a subset of the power relay coils, wherein the conductive shunt line configuration is selectively configurable based at least in part on a current rating of a receptacle associated with the packaged terminal air conditioner unit.

15. The packaged terminal air conditioning unit of claim 11, wherein the heater bank jumper is disposed between one or more contact point pairs, and wherein the one or more contact point pairs comprise a contact point of the controller and a contact point of a relay driver.

16. The packaged terminal air conditioning unit of claim 15, wherein the relay driver powers operation of the one or more power relay coils.

17. The packaged terminal air conditioner unit of claim 14, wherein each of the one or more power relay coils is configured to control the operation of at least one of the one or more heater banks.

18. The packaged terminal air conditioner unit of claim 14, wherein the heater bank jumper is coupled to a power cord having a plug configured to fit in the receptacle.

19. The packaged terminal air conditioner unit of claim 18, wherein the current rating of the receptacle is 15 amps, 20 amps, or 30 amps.

* * * * *